US011518561B2

(12) United States Patent
Martin

(10) Patent No.: US 11,518,561 B2
(45) Date of Patent: Dec. 6, 2022

(54) STRETCH WRAPPING MACHINE SUPPORTING MULTIPLE DISCRETE PRE-STRETCH AMOUNTS

(71) Applicant: Lantech.com, LLC, Louisville, KY (US)

(72) Inventor: Curtis W. Martin, Georgetown, IN (US)

(73) Assignee: LANTECH.COM, LLC, Louisville, KY (US)

( * ) Notice: Subject to any disclaimer, the term of this patent is extended or adjusted under 35 U.S.C. 154(b) by 114 days.

(21) Appl. No.: 16/929,669

(22) Filed: Jul. 15, 2020

(65) Prior Publication Data

US 2021/0039815 A1 Feb. 11, 2021

Related U.S. Application Data

(60) Provisional application No. 62/884,832, filed on Aug. 9, 2019.

(51) Int. Cl.

| | |
|---|---|
| ***B65B 41/16*** | (2006.01) |
| ***B65B 11/02*** | (2006.01) |
| *B65B 11/00* | (2006.01) |

(52) U.S. Cl.

CPC ..... *B65B 41/16* (2013.01); *B65B 11/025* (2013.01); *B65B 2011/002* (2013.01)

(58) Field of Classification Search

USPC ..... 53/441

See application file for complete search history.

(56) References Cited

U.S. PATENT DOCUMENTS

| | | | | |
|---|---|---|---|---|
| 4,336,679 | A * | 6/1982 | Lancaster | B65B 11/006 53/399 |
| 4,549,388 | A | 10/1985 | Lancaster | |
| 4,693,049 | A | 9/1987 | Humphrey | |
| 4,712,354 | A | 12/1987 | Lancaster et al. | |
| 5,311,725 | A * | 5/1994 | Martin | B65B 11/025 53/556 |
| 7,707,801 | B2 | 5/2010 | Lancaster, III | |
| 7,779,607 | B2 | 8/2010 | Lancaster, III et al. | |
| 8,141,327 | B2 | 3/2012 | Lancaster, III | |
| 8,276,346 | B2 | 10/2012 | Lancaster, III et al. | |
| 9,187,193 | B2 | 11/2015 | Lancaster, III | |
| 2001/0015057 | A1 | 8/2001 | Suolahti | |
| 2007/0204565 | A1 | 9/2007 | Lancaster, III et al. | |
| 2018/0290776 | A1 | 10/2018 | Cere | |

OTHER PUBLICATIONS

Utility U.S. Appl. No. 14/943,540 titled "Method and Apparatus for Dispensing an Amount of Film Relative to Load Girth" filed Nov. 17, 2015.

Utility U.S. Appl. No. 15/059,122 titled "Method and Apparatus for Metered Pre-stretch Film Delivery" filed Mar. 2, 2016.

Written Opinion and International Search Report for Application PCT/US2020/042184, dated Sep. 10, 2020.

* cited by examiner

*Primary Examiner* — Chinyere J Rushing-Tucker

(74) *Attorney, Agent, or Firm* — Middleton Reutlinger

(57) ABSTRACT

A packaging material dispenser of a stretch wrapping machine supports multiple discrete amounts of pre-stretch in a reliable and cost-effective manner in part by incorporating a loop drive assembly with multiple pre-stretch rate wheels capable of being used to drive a driven wheel associated with a pre-stretch roller at different discrete rates of rotation relative to another pre-stretch roller.

40 Claims, 6 Drawing Sheets

STRETCH WRAPPING MACHINE SUPPORTING MULTIPLE DISCRETE PRE-STRETCH AMOUNTS

FIELD OF THE INVENTION

The invention generally relates to wrapping loads with packaging material through relative rotation of loads and a packaging material dispenser.

BACKGROUND OF THE INVENTION

Various packaging techniques have been used to build a load of unit products and subsequently wrap them for transportation, storage, containment and stabilization, protection and waterproofing. One system uses wrapping machines to stretch, dispense, and wrap packaging material, e.g., film, around a load. The packaging material may be pre-stretched before it is applied to the load. Wrapping can be performed as an inline, automated packaging technique that dispenses and wraps packaging material in a stretch condition around a load on a pallet to cover and contain the load. Stretch wrapping, whether accomplished by a turntable, rotating arm, vertical rotating ring, or horizontal rotating ring, typically covers the four vertical sides of the load with a stretchable packaging material such as polyethylene packaging material. In each of these arrangements, relative rotation is provided between the load and the packaging material dispenser to wrap packaging material about the sides of the load.

With many stretch wrapping machines, packaging material is provided in roll form, generally with the packaging material wound around a hollow spool such as a cardboard tube. A packaging material dispenser generally includes a roll carrier including a shaft or mandrel that projects through the spool and allows the roll to rotate about a longitudinal axis to dispense a web of packaging material from the roll. A series of rollers guide the web of packaging material as the web is dispensed to a load, often with the speeds of at least some of the rollers controlled to pre-stretch the web.

In some stretch wrapping machines, a pre-stretch assembly is configured to provide a single, fixed amount of pre-stretch. Upstream and downstream pre-stretch rollers, for example, may be mechanically coupled to one another, e.g., using pulleys coupled together by a belt or sprockets coupled together by a chain, with the sizes of the pulleys/sprockets, as well as the sizes of the rollers themselves, configured to provide a predetermined amount of pre-stretch. In some instances, the pulleys/sprockets may be replaceable to vary the predetermined amount of pre-stretch, but such replacement is generally an offline process performed by an operator, requiring that the machine be taken offline for the amount of time required to manually replace the pulleys/sprockets.

In still other instances, servo motors may be used to drive the upstream and downstream pre-stretch rollers, with the rotational rates of the motors controlled during wrapping to provide a desired amount of pre-stretch. Servo motors, however, are relatively expensive and can be difficult to maintain at a fixed rotational ratio over time. Moreover, in some applications, e.g., rotating arm and ring applications, servo motors add mass to the packaging material dispenser, leading to increased forces during ring rotation at a given rate of rotation and often requiring heavier duty supporting structures (or alternatively a lower rate of rotation) to accommodate the increased forces.

Different pre-stretch amounts, however, may be best suited for different types of loads, so it may be desirable in some instances to support multiple pre-stretch amounts. Therefore, a continuing need exists in the art for a cost-effective, convenient, reliable and low maintenance way of supporting multiple pre-stretch amounts in a stretch wrapping machine.

SUMMARY OF THE INVENTION

The invention addresses these and other problems associated with the art by providing in one aspect a method and apparatus that support multiple discrete amounts of pre-stretch in part by incorporating a loop drive assembly with multiple pre-stretch rate wheels capable of being used to drive a driven wheel associated with a pre-stretch roller at different discrete rates of rotation relative to another pre-stretch roller. By selectively and operably coupling different pre-stretch rate wheels to a packaging material dispenser drive input, the different pre-stretch rate wheels can drive the driven wheel at different discrete rates and thereby configure the packaging material dispenser to utilize different discrete pre-stretch amounts.

Therefore, consistent with one aspect of the invention, an apparatus for wrapping a load with packaging material may include a packaging material dispenser for dispensing packaging material to the load and a rotational drive configured to generate relative rotation between the packaging material dispenser and the load about a center of rotation. The packaging material dispenser includes first and second pre-stretch rollers and a pre-stretch drive operably coupling the first and second pre-stretch rollers to one another to drive the second pre-stretch roller at one of first and second rates of rotation relative to the first pre-stretch roller. The pre-stretch drive includes a drive gear operably coupled to rotate the first pre-stretch roller, a driven wheel operably coupled to rotate the second pre-stretch roller, first and second pre-stretch rate assemblies, each of the first and second pre-stretch rate assemblies including a wheel operably coupled to rotate with an associated gear, the wheel and the associated gear of the first pre-stretch rate assembly configured to cause the second pre-stretch roller to rotate at the first rate of rotation relative to the first pre-stretch roller, and the wheel and the associated gear of the second pre-stretch rate assembly configured to cause the second pre-stretch roller to rotate at the second rate of rotation relative to the first pre-stretch roller, a continuous loop member operably coupling the wheels of the first and second pre-stretch rate assemblies to the driven wheel, a rate selection gear operably engaged with the drive gear and being movable between first and second positions, where in the first position the rate selection gear operably engages with the gear of the first pre-stretch rate assembly to operably couple the drive gear to the gear of the first pre-stretch rate assembly, and in the second position the rate selection gear operably engages with the gear of the second pre-stretch rate assembly to operably couple the drive gear to the gear of the second pre-stretch rate assembly.

In some embodiments, each of the driven wheel and the wheels of the first and second pre-stretch rate assemblies is a pulley and the continuous loop member is a belt. In addition, in some embodiments, each of the driven wheel and the wheels of the first and second pre-stretch rate assemblies is a toothed pulley and the continuous loop member is a toothed belt. Also, in some embodiments, each of the driven wheel and the wheels of the first and second pre-stretch rate assemblies is a sprocket and the continuous loop member is a chain.

Moreover, in some embodiments, the pre-stretch drive further includes a rate selection wheel that is rotatably mounted about a common axis of rotation with the rate selection gear, and the continuous loop member operably couples the rate selection wheel to the driven wheel and the wheels of the first and second pre-stretch rate assemblies. Further, in some embodiments, the pre-stretch drive further includes a tensioner wheel operably coupled to the driven wheel and the wheels of the first and second pre-stretch rate assemblies to maintain substantially constant tension in the continuous loop member.

Also, in some embodiments, the wheel and the associated gear of the first pre-stretch rate assembly are coaxial, the wheel and the associated gear of the second pre-stretch rate assembly are coaxial, the driven wheel and the second pre-stretch roller are coaxial, and the drive gear and the first pre-stretch roller are coaxial. Further, in some embodiments, each of the first and second pre-stretch rollers, the driven wheel, the drive gear, the wheel and the associated gear of the first pre-stretch rate assembly, the wheel and the associated gear of the second pre-stretch rate assembly, and the rate selection gear rotate about respective rotational axes that are generally parallel to one another.

In some embodiments, the rate selection gear is movable between first and second positions through generally linear movement. Also, in some embodiments, the rate selection gear is movable between first and second positions through generally rotational movement. In some embodiments, the pre-stretch drive further includes a rotatable actuation arm having an axis of rotation, the rate selection gear is rotatably mounted to the rotatable actuation arm, and the first and second positions of the rate selection gear respectively correspond to first and second rotational positions of the actuation arm. Further, in some embodiments, the axis of rotation of the actuation arm is coaxial with the drive gear.

In some embodiments, the pre-stretch drive further includes a position selector operably coupled to the actuation arm to rotate the actuation arm between the first and second rotational positions. Further, in some embodiments, the position selector is operably coupled to the actuation arm through a pin and slot mechanism. Also, in some embodiments, the pin and slot mechanism includes a pin disposed on the actuation arm and a slot disposed on the position selector.

In addition, in some embodiments, the position selector is rotatable about an axis of rotation, and when the actuation arm is in the first rotational position, the pin is oriented proximate a first end of the slot and when the actuation arm is in the second rotational position, the pin is oriented proximate a second end of the slot.

In some embodiments, the pre-stretch drive further includes a bias assembly configured to bias the actuation arm towards at least one of the first and second rotational positions. In addition, in some embodiments, the bias assembly biases the actuation arm towards the first rotational position when the actuation arm is within a first range of rotational positions adjacent the first rotational position and biases the actuation arm towards the second rotational position when the actuation arm is within a second range of rotational positions adjacent the first rotational position. Also, in some embodiments, the bias assembly includes a rotatable spring support disposed adjacent the position selector and a spring anchored between first and second spring mounts respectively disposed on the rotatable spring support and the position selector, and the rotatable spring support and the position selector include intermeshed teeth such that rotation of the actuation arm away from either of the first and second rotational positions rotates the rotatable spring support and the position selector to increase a distance between the first and second spring mounts.

In addition, some embodiments may also include a controlled actuator configured to rotate the actuation arm between the first and second rotational positions. In addition, in some embodiments, the controlled actuator is a linear actuator, a pneumatic actuator, a hydraulic actuator or a solenoid. In some embodiments, the controlled actuator is a first controlled actuator configured to rotate the actuation arm from the first rotational position to the second rotational position, and the pre-stretch drive further includes a second controlled actuator configured to rotate the actuation arm from the second rotational position to the first rotational position.

Further, in some embodiments, the pre-stretch drive further includes a rotatable position selector operably coupled to the actuation arm to rotate the actuation arm between the first and second rotational positions, and a bias assembly configured to bias the actuation arm towards the first rotational position when the actuation arm is within a first range of rotational positions adjacent the first rotational position and bias the actuation arm towards the second rotational position when the actuation arm is within a second range of rotational positions adjacent the first rotational position, where the position selector includes one or more actuation members, and where the first controlled actuator is configured to engage an actuation member from among the one or more actuation members of the position selector to rotate the actuation arm into the second range of rotational positions and the second controlled actuator is configured to engage an actuation member from among the one or more actuation members of the position selector to rotate the actuation arm into the first range of rotational positions.

In addition, some embodiments may also include a controller coupled to the packaging material dispenser and the rotational drive and configured to control a dispense rate of the packaging material dispenser during relative rotation between the packaging material dispenser and the load, and the controller is further configured to actuate the pre-stretch drive to select between the first and second rates of rotation. Some embodiments may further include a ring, and the packaging material dispenser is supported on the ring and the rotational drive rotates the ring to rotate the packaging material dispenser about the load.

Consistent with another aspect of the invention, a packaging material dispenser for dispensing packaging material to a load during relative rotation between the packaging material dispenser and the load may include first and second pre-stretch rollers, and a pre-stretch drive operably coupling the first and second pre-stretch rollers to one another to drive the second pre-stretch roller at one of first and second rates of rotation relative to the first pre-stretch roller. The pre-stretch drive includes a drive gear operably coupled to rotate the first pre-stretch roller, a driven wheel operably coupled to rotate the second pre-stretch roller, first and second pre-stretch rate assemblies, each of the first and second pre-stretch rate assemblies including a wheel operably coupled to rotate with an associated gear, the wheel and the associated gear of the first pre-stretch rate assembly configured to cause the second pre-stretch roller to rotate at the first rate of rotation relative to the first pre-stretch roller, and the wheel and the associated gear of the second pre-stretch rate assembly configured to cause the second pre-stretch roller to rotate at the second rate of rotation relative to the first pre-stretch roller, a continuous loop member operably coupling the wheels of the first and second pre-stretch rate assemblies to the driven wheel, and a rate selection gear operably engaged with the drive gear and being movable between first and second positions, where in the first position the rate selection gear operably engages with the gear of the first pre-stretch rate assembly to operably couple the drive gear to the gear of the first pre-stretch rate assembly, and in the second position the rate selection gear operably engages with the gear of the second pre-stretch rate assembly to operably couple the drive gear to the gear of the second pre-stretch rate assembly.

Consistent with another aspect of the invention, a method of wrapping a load with packaging material using a wrapping apparatus of the type including a packaging material dispenser for dispensing packaging material to the load may include rotating a first pre-stretch roller of the packaging material dispenser at a controlled rate of rotation in response to a packaging material dispenser drive input, rotating a second pre-stretch roller of the packaging material dispenser in response to rotation of a driven wheel, driving the driven wheel using a continuous loop member operably coupling the driven wheel to respective wheels of first and second pre-stretch rate assemblies, the first and second pre-stretch rate assemblies each further including respective gears configured to rotate with the respective wheels thereof, the wheel and the gear of the first pre-stretch rate assembly configured to cause the second pre-stretch roller to rotate at a first rate of rotation relative to the controlled rate of rotation of the first pre-stretch roller, and the wheel and the associated gear of the second pre-stretch rate assembly configured to cause the second pre-stretch roller to rotate at the second rate of rotation relative to the controlled rate of rotation of the first pre-stretch roller, rotating a drive gear operably coupled to the first pre-stretch roller in response to the packaging material dispenser drive input, selecting the first rate of rotation for the second pre-stretch roller by moving a rate selection gear operably engaged with the drive gear to a first position in which the rate selection gear operably engages with the gear of the first pre-stretch rate assembly to operably couple the drive gear to the gear of the first pre-stretch rate assembly, and selecting the second rate of rotation for the second pre-stretch roller by moving the rate selection gear to a second position in which the rate selection gear operably engages with the gear of the second pre-stretch rate assembly to operably couple the drive gear to the gear of the second pre-stretch rate assembly.

Consistent with another aspect of the invention, a method of wrapping a load with packaging material using a wrapping apparatus of the type including a packaging material dispenser for dispensing packaging material to the load may include rotating a first pre-stretch roller of the packaging material dispenser at a controlled rate of rotation in response to a packaging material dispenser drive input, rotating a second pre-stretch roller of the packaging material dispenser using a loop drive assembly including first and second pre-stretch rate wheels, a driven wheel operably coupled to rotate the second pre-stretch roller, and a continuous loop member operably coupling the first and second pre-stretch rate wheels and the driven wheel, selecting a first rate of rotation at which to rotate the second pre-stretch roller relative to the first pre-stretch roller by actuating a rate selection assembly to operably couple the packaging material dispenser drive input to the first pre-stretch rate wheel such that the first pre-stretch rate wheel drives the loop drive assembly in response to the packaging material dispenser drive input, and selecting a second rate of rotation at which to rotate the second pre-stretch roller relative to the first pre-stretch roller by actuating the rate selection assembly to operably couple the packaging material dispenser drive input to the second pre-stretch rate wheel such that the second pre-stretch rate wheel drives the loop drive assembly in response to the packaging material dispenser drive input. The rate selection assembly and the first pre-stretch rate wheel are configured such that when the rate selection assembly is actuated to operably couple the packaging material dispenser drive input to the first pre-stretch rate wheel, the second pre-stretch roller is driven at the first rate of rotation relative to the first pre-stretch roller, and such that when the rate selection assembly is actuated to operably couple the packaging material dispenser drive input to the second pre-stretch rate wheel, the second pre-stretch roller is driven at the second rate of rotation relative to the first pre-stretch roller.

Moreover, in some embodiments, each of the driven wheel and the first and second pre-stretch rate wheels is a pulley and the continuous loop member is a belt. Further, in some embodiments, each of the driven wheel and the first and second pre-stretch rate wheels is a sprocket and the continuous loop member is a chain. Some embodiments may also include rotating a drive gear operably coupled to the first pre-stretch roller in response to the packaging material dispenser drive input, where actuating the rate selection assembly to operably couple the packaging material dispenser drive input to the first pre-stretch rate wheel includes moving a rate selection gear operably engaged with the drive gear to a first position in which the rate selection gear operably engages with a first pre-stretch rate gear operably coupled to rotate with the first pre-stretch rate wheel, and where actuating the rate selection assembly to operably couple the packaging material dispenser drive input to the second pre-stretch rate wheel includes moving the rate selection gear to a second position in which the rate selection gear operably engages with a second pre-stretch rate gear operably coupled to rotate with the second pre-stretch rate wheel.

In some embodiments, the loop drive assembly further includes a tensioner wheel and a rate selection wheel that is rotatably mounted about a common axis of rotation with the rate selection gear, and the continuous loop member operably couples the rate selection wheel and the tensioner wheel to the driven wheel and the first and second pre-stretch rate wheels. Moreover, in some embodiments, the rate selection gear is rotatably mounted to a rotatable actuation arm having an axis of rotation, the first and second positions of the rate selection gear respectively correspond to first and second rotational positions of the actuation arm, actuating the rate selection assembly to operably couple the packaging material dispenser drive input to the first pre-stretch rate wheel includes rotating the actuation arm to the first rotational position, and actuating the rate selection assembly to operably couple the packaging material dispenser drive input to the second pre-stretch rate wheel includes rotating the actuation arm to the second rotational position.

Further, in some embodiments, the actuation arm is operably coupled to a rotatable position selector through a pin and slot mechanism, when the actuation arm is in the first rotational position, the pin is oriented proximate a first end of the slot and when the actuation arm is in the second rotational position, the pin is oriented proximate a second end of the slot, a bias assembly coupled to the rotatable position selector biases the actuation arm towards the first rotational position when the actuation arm is within a first range of rotational positions adjacent the first rotational position and biases the actuation arm towards the second rotational position when the actuation arm is within a second range of rotational positions adjacent the first rotational position, actuating the rate selection assembly to operably couple the packaging material dispenser drive input to the first pre-stretch rate wheel includes rotating the actuation arm to a rotational position within the first range of rotational positions such that the bias assembly further rotates the actuation arm to the first rotational position, and actuating the rate selection assembly to operably couple the packaging material dispenser drive input to the second pre-stretch rate wheel includes rotating the actuation arm to a rotational position within the second range of rotational positions such that the bias assembly further rotates the actuation arm to the second rotational position.

In addition, in some embodiments, actuating the rate selection assembly to operably couple the packaging material dispenser drive input to the first pre-stretch rate wheel includes actuating a first controlled actuator that pushes the position selector to rotate the actuation arm to the rotational position within the first range of rotational positions, and actuating the rate selection assembly to operably couple the packaging material dispenser drive input to the second pre-stretch rate wheel includes actuating a second controlled actuator that pushes the position selector to rotate the actuation arm to the rotational position within the second range of rotational positions. Also, in some embodiments, each of the first and second controlled actuators is a linear actuator, a pneumatic actuator, a hydraulic actuator or a solenoid.

Consistent with another aspect of the invention, an apparatus for wrapping a load with packaging material may include a packaging material dispenser configured to perform any of the aforementioned methods.

Consistent with yet another aspect of the invention, a packaging material dispenser for dispensing packaging material to a load during relative rotation between the packaging material dispenser and the load may include first and second pre-stretch rollers, and a pre-stretch drive operably coupling the first and second pre-stretch rollers to one another to drive the second pre-stretch roller at one of first and second rates of rotation relative to the first pre-stretch roller. The pre-stretch drive may include a loop drive assembly including first and second pre-stretch rate wheels, a driven wheel operably coupled to rotate the second pre-stretch roller, and a continuous loop member operably coupling the first and second pre-stretch rate wheels and the driven wheel, and a rate selection assembly operably coupled to a packaging material dispenser drive input and operable in first and second modes, where in the first mode the rate selection assembly operably couples the packaging material drive input to the first pre-stretch rate wheel to drive the loop drive assembly using the first pre-stretch rate wheel, and in the second mode the rate selection assembly operably couples the packaging material drive input to the second pre-stretch rate wheel to drive the loop drive assembly using the second pre-stretch rate wheel. In addition, the rate selection assembly and the first pre-stretch rate wheel are configured such that when the rate selection assembly is in the first mode, the second pre-stretch roller is driven at the first rate of rotation relative to the first pre-stretch roller, and such that when the rate selection assembly is in the second mode, the second pre-stretch roller is driven at the second rate of rotation relative to the first pre-stretch roller.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described exemplary embodiments of the invention.

DETAILED DESCRIPTION

In the embodiments discussed hereinafter, a packaging material dispenser of a stretch wrapping machine supports multiple discrete amounts of pre-stretch in a reliable and cost-effective manner in part by incorporating a loop drive assembly with multiple pre-stretch rate wheels capable of being used to drive a driven wheel associated with a pre-stretch roller at different discrete rates of rotation relative to another pre-stretch roller. By selectively and operably coupling different pre-stretch rate wheels to a packaging material dispenser drive input, the different pre-stretch rate wheels can drive the driven wheel at different discrete rates and thereby configure the packaging material dispenser to utilize different discrete pre-stretch amounts.

Figure 1:
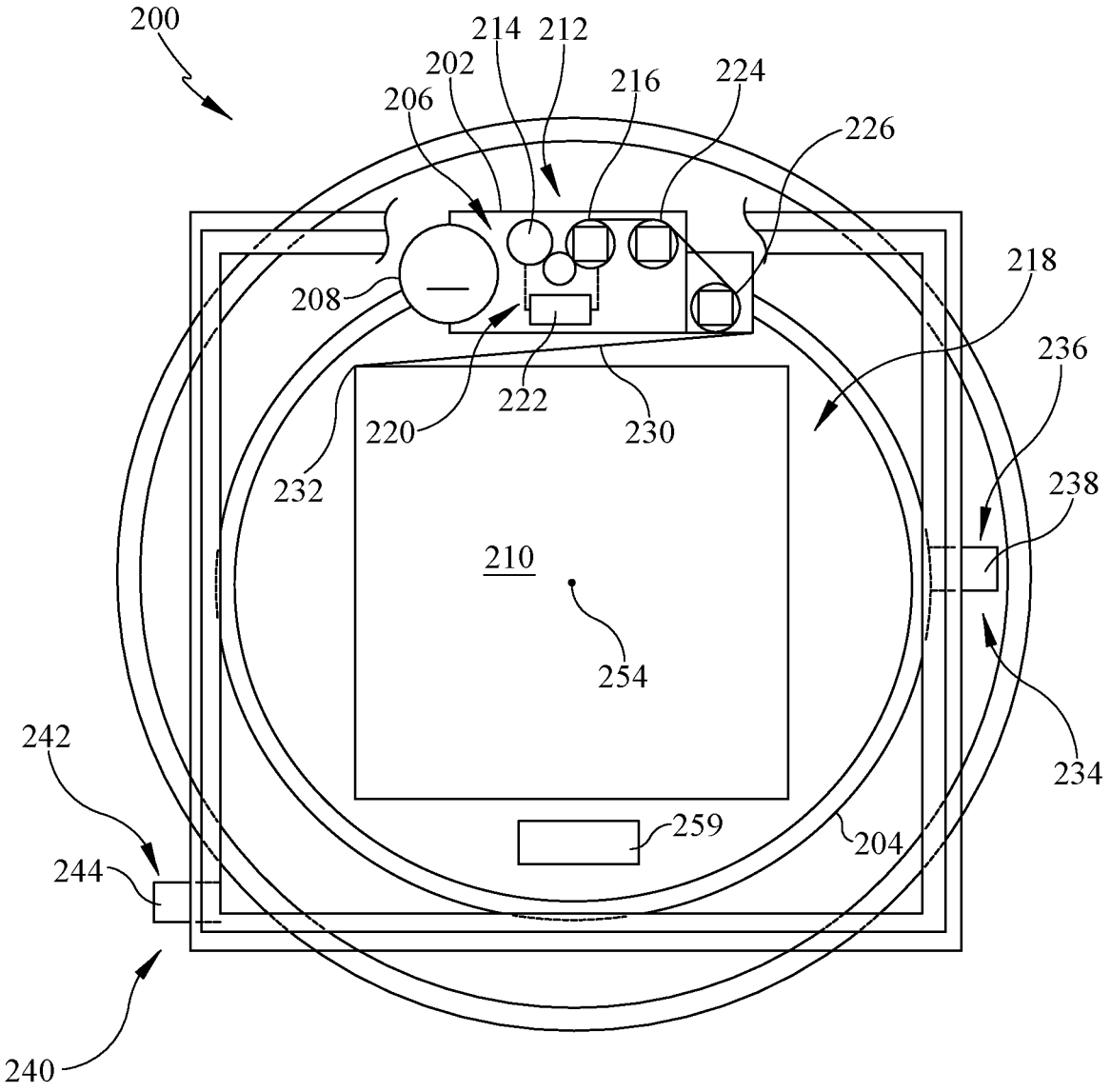
FIG. 1 shows a top view of a rotating ring-type wrapping apparatus consistent with the invention.

Turning to the drawings, wherein like parts are denoted by like numbers throughout the several views, FIG. 1 illustrates a rotating ring-type stretch wrapping machine or apparatus 200, which may include a roll carriage 202 mounted on a rotating ring 204, and upon which dual pre-stretch consistent with the invention may be implemented. Roll carriage 202 may include a packaging material dispenser 206. Packaging material dispenser 206 may be configured to dispense packaging material 208 as rotating ring 204 rotates relative to a load 210 to be wrapped. In an example embodiment, packaging material dispenser 206 may be configured to dispense stretch wrap packaging material. As used herein, stretch wrap packaging material is defined as material, e.g., a film, having a high yield coefficient to allow the packaging material a large amount of stretch during wrapping. However, it is possible that the apparatuses and methods disclosed herein may in some instances be practiced with other types of packaging material, e.g., netting, strapping, banding, tape, film without a high yield coefficient, etc. The invention is therefore not limited to use with stretch wrap packaging material.

Packaging material dispenser 206 may include a pre-stretch assembly 212 including an upstream dispensing roller 214 and a downstream dispensing roller 216, and a packaging material drive system 220, including, for example, an electric or hydrostatic motor 222, may be used to drive dispensing rollers 214 and 216. Downstream of downstream dispensing roller 216 may be provided one or more idle rollers 224, 226, with the most downstream idle roller 226 effectively providing an exit point from packaging material dispenser 206, such that a portion 230 of packaging material 208 extends between the exit point and a contact point 232 where the packaging material engages load 210. It is contemplated that pre-stretch assembly 212 may include various configurations and numbers of pre-stretch rollers, drive or driven roller and idle rollers without departing from the spirit and scope of the invention.

The terms "upstream" and "downstream," as used in this application, are intended to define positions and movement relative to the direction of flow of packaging material 208 as it moves from packaging material dispenser 206 to load 210. Movement of an object toward packaging material dispenser 206, away from load 210, and thus, against the direction of flow of packaging material 208, may be defined as "upstream." Similarly, movement of an object away from packaging material dispenser 206, toward load 210, and thus, with the flow of packaging material 208, may be defined as "downstream." Also, positions relative to load 210 (or a load support surface 218) and packaging material dispenser 206 may be described relative to the direction of packaging material flow. For example, when two pre-stretch rollers are present, the pre-stretch roller closer to packaging material dispenser 206 may be characterized as the "upstream" roller and the pre-stretch roller closer to load 210 (or the load support surface 218) and further from packaging material dispenser 206 may be characterized as the "downstream" roller.

Wrapping apparatus 200 also includes a relative rotation assembly 234 configured to rotate rotating ring 204, and thus, packaging material dispenser 206 mounted thereon, relative to load 210 as load 210 is supported on load support surface 218. Relative rotation assembly 234 may include a rotational drive system 236, including, for example, an electric motor 238. Wrapping apparatus 200 may further include a lift assembly 240, which may be powered by a lift drive system 242, including, for example, an electric motor 244, that may be configured to move rotating ring 204 and roll carriage 202 vertically relative to load 210.

In some embodiments, packaging material drive system 220 may be driven by a ring belt disposed on a fixed ring and in response to rotation of rotating ring 204. In other embodiments, packaging material drive system 220 may be driven by a separate ring belt coupled to a fixed or rotating ring to provide for control over dispense rate independent of the rate of relative rotation.

In addition, wrapping apparatus 200 may include sensors on one or more of downstream dispensing roller 216, idle roller 224 and idle roller 226, and an angle sensor may be provided for determining an angular relationship between load 210 and packaging material dispenser 206 about a center of rotation 254 (through which projects an axis of rotation that is perpendicular to the view illustrated in FIG. 1), and in some embodiments, one or both of a load distance sensor and a film angle sensor may also be provided. An angle sensor may be positioned proximate center of rotation 254, or alternatively, may be positioned at other locations, such as proximate rotating ring 204. Wrapping apparatus 200 may also include additional components used in connection with other aspects of a wrapping operation, e.g., a clamping device 259 may be used to grip the leading end of packaging material 208 between cycles, and/or a top sheet dispenser (not shown) may be used to dispense a sheet of packaging material onto the top of a load.

During a typical wrapping operation, a clamping device, e.g., as known in the art, is used to position a leading edge of the packaging material on the load such that when relative rotation between the load and the packaging material dispenser is initiated, the packaging material will be dispensed from the packaging material dispenser and wrapped around the load. In addition, as pre-stretching is used, the packaging material is stretched prior to being conveyed to the load. The dispense rate of the packaging material is controlled during the relative rotation between the load and the packaging material, and a lift assembly controls the position, e.g., the height, of the web of packaging material engaging the load so that the packaging material is wrapped in a spiral manner around the load from the base or bottom of the load to the top. Multiple layers of packaging material may be wrapped around the load over multiple passes to increase overall containment force, and once the desired amount of packaging material is dispensed, the packaging material is severed to complete the wrap.

Figure 2:
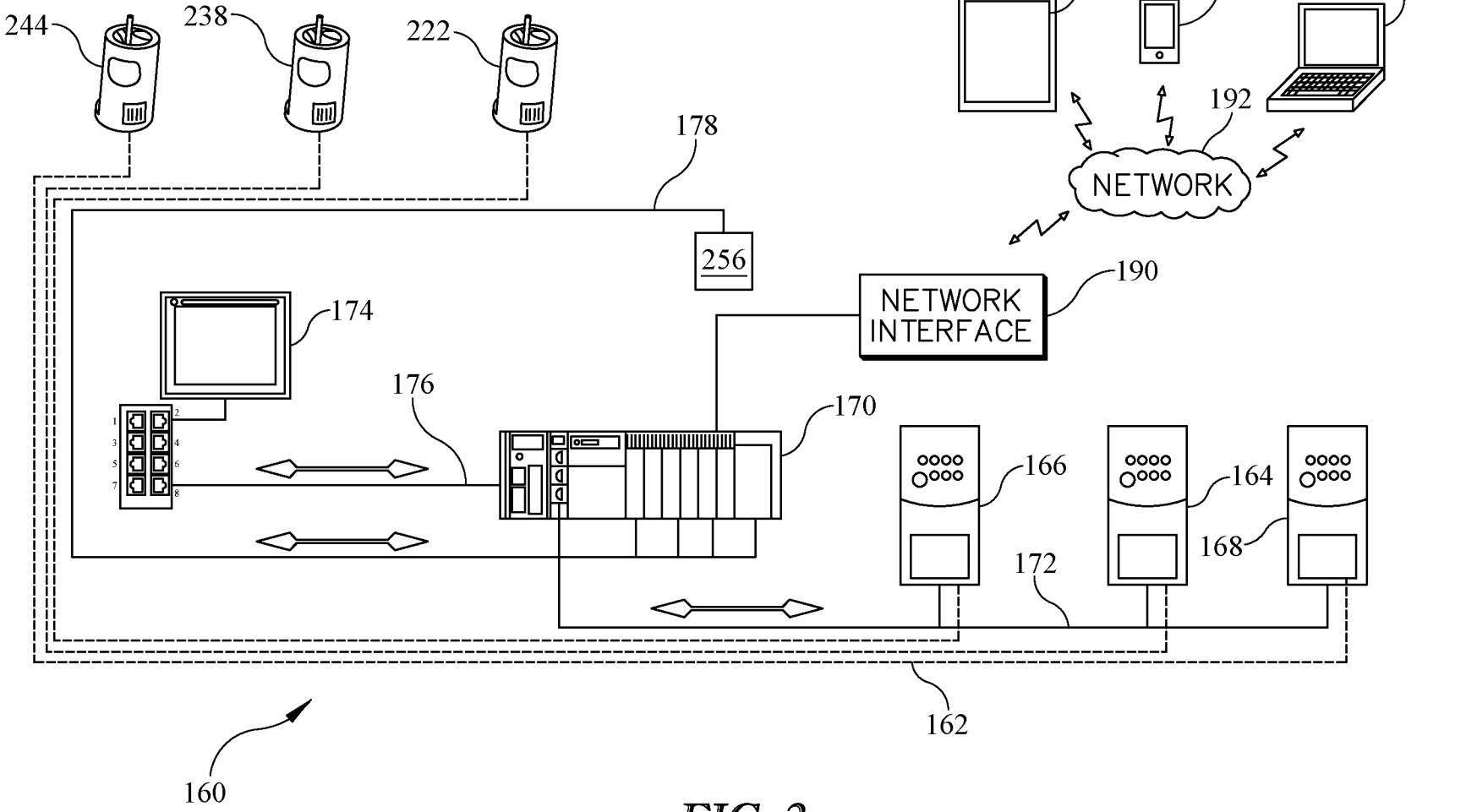
FIG. 2 is a schematic view of an example control system for use in the apparatus of FIG. 1.

An example schematic of a control system 160 for wrapping apparatus 200 is shown in FIG. 2. Motor 222 of packaging material drive system 220, motor 238 of rotational drive system 236, and motor 244 of lift drive system 242 may communicate through one or more data links 162 with a rotational drive variable frequency drive ("VFD") 164, a packaging material drive VFD 166, and a lift drive VFD 168, respectively. Rotational drive VFD 164, packaging material drive VFD 166, and lift drive VFD 168 may communicate with a controller 170 through a data link 172. It should be understood that rotational drive VFD 164, packaging material drive VFD 166, and lift drive VFD 168 may produce outputs to controller 170 that controller 170 may use as indicators of rotational movement.

Controller 170 may include hardware components and/or software program code that allow it to receive, process, and transmit data. It is contemplated that controller 170 may be implemented as a programmable logic controller (PLC), or may otherwise operate similar to a processor in a computer system. Controller 170 may communicate with an operator interface 174 via a data link 176. Operator interface 174 may include a display or screen and controls that provide an operator with a way to monitor, program, and operate wrapping apparatus 100. For example, an operator may use operator interface 174 to enter or change predetermined and/or desired settings and values, or to start, stop, or pause the wrapping cycle. Controller 170 may also communicate with one or more sensors (collectively represented at 256) through a data link 178, thus allowing controller 170 to receive performance related data during wrapping. It is contemplated that data links 162, 172, 176, and 178 may include any suitable wired and/or wireless communications media known in the art.

For the purposes of the invention, controller 170 may represent practically any type of computer, computer system, controller, logic controller, or other programmable electronic device, and may in some embodiments be implemented using one or more networked computers or other electronic devices, whether located locally or remotely with respect to wrapping apparatus 200.

Controller 170 typically includes a central processing unit including at least one microprocessor coupled to a memory, which may represent the random access memory (RAM) devices comprising the main storage of controller 170, as well as any supplemental levels of memory, e.g., cache memories, non-volatile or backup memories (e.g., programmable or flash memories), read-only memories, etc. In addition, the memory may be considered to include memory storage physically located elsewhere in controller 170, e.g., any cache memory in a processor, as well as any storage capacity used as a virtual memory, e.g., as stored on a mass storage device or on another computer or electronic device coupled to controller 170. Controller 170 may also include one or more mass storage devices, e.g., a floppy or other removable disk drive, a hard disk drive, a direct access storage device (DASD), an optical drive (e.g., a CD drive, a DVD drive, etc.), and/or a tape drive, among others.

Furthermore, controller 170 may include an interface 190 with one or more networks 192 (e.g., a LAN, a WAN, a wireless network, and/or the Internet, among others) to permit the communication of information to the components in wrapping apparatus 100 as well as with other computers and electronic devices, e.g. computers such as a desktop computer or laptop computer 194, mobile devices such as a mobile phone 196 or tablet 198, multi-user computers such as servers or cloud resources, etc. Controller 170 operates under the control of an operating system, kernel and/or firmware and executes or otherwise relies upon various computer software applications, components, programs, objects, modules, data structures, etc. Moreover, various applications, components, programs, objects, modules, etc. may also execute on one or more processors in another computer coupled to controller 170, e.g., in a distributed or client-server computing environment, whereby the processing required to implement the functions of a computer program may be allocated to multiple computers over a network.

In general, the routines executed to implement the embodiments of the invention, whether implemented as part of an operating system or a specific application, component, program, object, module or sequence of instructions, or even a subset thereof, will be referred to herein as "computer program code," or simply "program code." Program code typically comprises one or more instructions that are resident at various times in various memory and storage devices in a computer, and that, when read and executed by one or more processors in a computer, cause that computer to perform the steps necessary to execute steps or elements embodying the various aspects of the invention. Moreover, while the invention has and hereinafter will be described in the context of fully functioning controllers, computers and computer systems, those skilled in the art will appreciate that the various embodiments of the invention are capable of being distributed as a program product in a variety of forms, and that the invention applies equally regardless of the particular type of computer readable media used to actually carry out the distribution.

Such computer readable media may include computer readable storage media and communication media. Computer readable storage media is non-transitory in nature, and may include volatile and non-volatile, and removable and non-removable media implemented in any method or technology for storage of information, such as computer-readable instructions, data structures, program modules or other data. Computer readable storage media may further include RAM, ROM, erasable programmable read-only memory (EPROM), electrically erasable programmable read-only memory (EEPROM), flash memory or other solid state memory technology, CD-ROM, digital versatile disks (DVD), or other optical storage, magnetic cassettes, magnetic tape, magnetic disk storage or other magnetic storage devices, or any other medium that can be used to store the desired information and which can be accessed by controller 170. Communication media may embody computer readable instructions, data structures or other program modules. By way of example, and not limitation, communication media may include wired media such as a wired network or direct-wired connection, and wireless media such as acoustic, RF, infrared and other wireless media. Combinations of any of the above may also be included within the scope of computer readable media.

Various program code described hereinafter may be identified based upon the application within which it is implemented in a specific embodiment of the invention. However, it should be appreciated that any particular program nomenclature that follows is used merely for convenience, and thus the invention should not be limited to use solely in any specific application identified and/or implied by such nomenclature. Furthermore, given the typically endless number of manners in which computer programs may be organized into routines, procedures, methods, modules, objects, and the like, as well as the various manners in which program functionality may be allocated among various software layers that are resident within a typical computer (e.g., operating systems, libraries, API's, applications, applets, etc.), it should be appreciated that the invention is not limited to the specific organization and allocation of program functionality described herein.

In the discussion hereinafter, the hardware and software used to control wrapping apparatus 200 is assumed to be incorporated wholly within components that are local to wrapping apparatus 200 illustrated in FIGS. 1-2. It will be appreciated, however, that in other embodiments, at least a portion of the functionality incorporated into a wrapping apparatus may be implemented in hardware and/or software that is external to the aforementioned components. For example, in some embodiments, some user interaction may be performed using a networked computer or mobile device, with the networked computer or mobile device converting user input into control variables that are used to control a wrapping operation. In other embodiments, user interaction may be implemented using a web-type interface, and the conversion of user input may be performed by a server or a local controller for the wrapping apparatus, and thus external to a networked computer or mobile device. In still other embodiments, a central server may be coupled to multiple wrapping stations to control the wrapping of loads at the different stations. As such, the operations of receiving user input, converting the user input into control variables for controlling a wrap operation, initiating and implementing a wrap operation based upon the control variables, providing feedback to a user, etc., may be implemented by various local and/or remote components and combinations thereof in different embodiments. As such, the invention is not limited to the particular allocation of functionality described herein.

Those skilled in the art will recognize that the exemplary environments illustrated in FIGS. 1-2 are not intended to limit the present invention. Indeed, those skilled in the art will recognize that other alternative environments may be used without departing from the scope of the invention. For example, it will be appreciated that aspects of the invention may be used in other stretch wrapping machines, including horizontal rotating ring-based wrapping machines, rotating arm-based wrapping machines and turntable-based wrapping machines. Therefore, the invention is not limited to use in a vertical rotating ring-based wrapping machine.

Packaging Material Dispenser Supporting Multiple Discrete Pre-Stretch Amounts In some embodiments of the invention, it may be desirable to support multiple discrete amounts of pre-stretch in a packaging material dispenser. Some conventional designs have supported different pre-stretch amounts only through an offline maintenance process, e.g., via manual replacement of the gears, pulleys or sprockets that mechanically couple together the upstream and downstream pre-stretch rollers. Changing a pre-stretch amount in such designs, however, results in considerable downtime that is generally undesirable in modern manufacturing and distribution centers. Other conventional designs have utilized servo motors to independently drive pre-stretch rollers; however, such designs are relatively expensive and complex, and particularly in rotating arm-type and ring-type stretch wrapping machines, undesirably increase the rotating mass of the packaging material dispenser.

In embodiments consistent with the invention, on the other hand, a packaging material dispenser of a stretch wrapping machine may support a set of discrete amounts of pre-stretch in a reliable and cost-effective manner in part by incorporating a loop drive assembly with multiple pre-stretch rate wheels capable of being used to drive a driven wheel associated with a pre-stretch roller at different discrete rates of rotation relative to another pre-stretch roller. In addition, in some embodiments a rate selection assembly may further be used to selectively and operably couple the different pre-stretch rate wheels to a packaging material dispenser drive input, such that at any particular time one of the different pre-stretch rate wheels may be used to drive the driven wheel at a particular discrete rate and thereby configure the packaging material dispenser to select one among a set of supported discrete pre-stretch amounts.

As illustrated in FIGS. 3-6, one example implementation of a ring-type wrapping apparatus 300 may include a packaging material dispenser 302 including a downstream pre-stretch roller 304, an upstream pre-stretch roller 306 and a pre-stretch drive 308 configured to drive the pre-stretch rollers 304, 306 at predetermined relative rates to apply a controlled amount of pre-stretch to a web of packaging material dispensed by the packaging material dispenser. In the illustrated embodiment, pre-stretch drive 308 includes a loop drive assembly 310 and a rate selection assembly 312, with the loop drive assembly 310 configured to drive upstream pre-stretch roller 304 at one of a plurality of discrete rates of rotation relative to rotation of upstream pre-stretch roller 306, and with the rate selection assembly 312 configured to configure the loop drive assembly 310 to drive the upstream pre-stretch roller 304 at a selected one of the discrete rates of rotation supported by the loop drive assembly.

Loop drive assembly 310 in the illustrated embodiment includes a continuous loop member 314 that is wound around a driven wheel 316 and first and second pre-stretch rate wheels 318, 320 of respective first and second pre-stretch rate assemblies 322, 324. In the illustrated embodiment, continuous loop member 314 is a toothed, timing or synchronous belt, and wheels 316, 318 and 320 are toothed pulleys. It will be appreciated, however, that in other embodiments, other loop drive arrangements may be used, e.g., non-toothed belts and pulleys or chains and sprockets, among others. Accordingly, it will be appreciated that the term "continuous loop member" may be considered to incorporate various types of flexible loops capable of transmitting mechanical power (e.g., belts, chains, etc.), and the term "wheel" may be considered to incorporate various types of rotatable members capable of driving and/or being driven by such loops (e.g., pulleys, sprockets, etc.).

Driven wheel 316 is operably coupled to rotate upstream pre-stretch roller 306. In the illustrated embodiment, for example, driven wheel 316 is coaxial with roller 306 (e.g., mounted to the same shaft), although it will be appreciated that other mechanical couplings may be used in other embodiments (e.g., via one or more intermediate gears, chains, belts, etc.).

Each pre-stretch rate assembly 322, 324 in the illustrated embodiment includes, in addition to an associated pre-stretch rate wheel 318, 320 that engages continuous loop member 314, an associated pre-stretch rate gear 326, 328 operably coupled thereto such that rotation of the gear 326, 328 rotates the associated wheel 318, 320. In the illustrated embodiment, wheels 318, 320 are coaxial with and mounted to the same rotational shaft as gears 326, 328, and are locked with one another to rotate at the same rate of rotation, although as with the driven wheel 316 various other mechanical couplings may be used in other embodiments. Loop drive assembly 310 may also in some embodiments include a tensioning mechanism, e.g., a tensioner wheel 330 mounted on a tensioning arm 332 that is biased to maintain a substantially constant tension in continuous loop member 314.

Rate selection assembly 312 includes a rate selection gear 334 that is operably engaged with a drive gear 336 that is operably coupled to rotate downstream pre-stretch roller 304. Drive gear 336 is in turn operably coupled to a packaging material dispenser drive input 338, which in the illustrated embodiment, is a toothed pulley configured to be driven by a ring belt coupled to a fixed or rotating ring. It will be appreciated that other drive inputs may be used for other packaging material dispensers, particularly for other types of stretch wrapping machines, e.g., servo or other electric motors. In the illustrated embodiment, drive gear 336 and packaging material dispenser drive input 338 are coaxial with and mounted to the same rotational shaft as downstream pre-stretch roller 304 and are locked with one another to rotate at the same rate of rotation, although as above various other mechanical couplings may be used in other embodiments to operably interconnect these components.

A rate selection wheel 340 (e.g., a non-toothed pulley) may also be rotatably mounted about a common axis of rotation with rate selection gear 334 to engage continuous loop member 314 intermediate wheels 318, 320. Wheel 340 may be mounted to the same shaft as gear 334 in some embodiments, or may be rotatably mounted on a different shaft, although wheel 340 may also be omitted in some embodiments. Moreover, wheel 340, while being coaxial, may rotate at different rate from gear 334 in some embodiments.

In order to select between different amounts of pre-stretch, rate selection gear 334 is movable between two positions, a first position (illustrated in FIG. 5) in which rate selection gear 334 engages first pre-stretch rate gear 326 to operably couple drive gear 336 to first pre-stretch rate gear 326, and a second position (illustrated in FIG. 6) in which rate selection gear 334 engages second pre-stretch rate gear 328 to operably couple drive gear 336 to second pre-stretch rate gear 328. It should be noted that when a particular pre-stretch rate gear 326, 328 is disengaged from rate selection gear 334, the associated pre-stretch rate assembly 322, 324 is effectively idle, rotated in response to movement of continuous loop member 314 being driven by the other (currently engaged) pre-stretch rate assembly. In the illustrated embodiment, this movement between positions is effected through rotational movement, using an actuation arm 342 to which rate selection gear 334 is rotatably mounted. Actuation arm 342 is rotatable about an axis of rotation that is coextensive and parallel to downstream pre-stretch roller 304 (i.e., actuation arm 342 is coaxial with both drive gear 336 and roller 304), such that rotation of actuation arm 342 moves pre-stretch rate gear 326 between engagement with first pre-stretch rate gear 326 and engagement with second pre-stretch rate gear 328. In other embodiments, actuation arm 342 may be rotatable about a different rotational axis, and in still other embodiments, rate selection gear 334 may be movable between the first and second positions using linear movement or a combination of linear and rotational movement, using alternate mechanical couplings that will be appreciated by those having the benefit of the instant disclosure.

It will be appreciated that the pre-stretch amount is a function of the configurations (e.g., the diameters or circumferences) and relative rates of rotation of downstream and upstream pre-stretch rollers 304, 306, and moreover, that the relative rates of rotation of these rollers is controlled in part by the configuration (e.g., the diameter or circumference) of each of driven wheel 316, first and second pre-stretch rate wheels 318, 320, first and second pre-stretch rate gears 326, 328, rate selection gear 334 and drive gear 336, as the relative configurations of these various components that link together rollers 304, 306 will generally impact the relative rotation rates. Furthermore, the differences in the configurations of pre-stretch rate assemblies 322, 324 will generally distinguish the two different pre-stretch amounts supported by packaging material dispenser 302. In some embodiments, only pre-stretch rate wheels 318, 320 may differ in configuration from one another, while in other embodiments, only pre-stretch rate gears 326, 328 will differ in configuration from one another. In still other embodiments, both pre-stretch rate wheels 318, 320 and pre-stretch rate gears 326, 328 may differ from one another in order to provide the desired different pre-stretch amounts. Accordingly, it will be appreciated that selection of the various components in packaging material dispenser 302 to provide the desired pre-stretch amounts would be well within the abilities of those having the benefit of the instant disclosure.

It will also be appreciated that in the illustrated embodiment first pre-stretch rate wheel 318 and first pre-stretch rate gear 326 are coaxial with one another, as are second pre-stretch rate wheel 320 and second pre-stretch rate gear 328, upstream pre-stretch roller 306 and driven wheel 316, rate selection gear 334 and rate selection wheel 340, and downstream pre-stretch roller 304, drive gear 336, packaging material dispenser drive input 338, and actuation arm 342. Moreover, each of these components, as well as tensioner wheel 330 and tensioning arm 332 all rotate about respective rotational axes that are generally parallel to one another. In other embodiments, however, the orientations of some of these components may vary, and alternate mechanical couplings may be used in some embodiments such that various coaxial elements in packaging material dispenser 302 are no longer coaxial with one another. Therefore, the invention is not limited to the particular configuration of packaging material dispenser 302 illustrated in FIGS. 3-6.

Control over the position of rate selection gear 334, and thus selection of a particular pre-stretch amount, as noted above, may be effected in the illustrated embodiment via rotation of actuation arm 342. In the illustrated embodiment, actuation arm 342 includes first and second ends 344, 346, with rate selection gear 334 rotatably mounted proximate first end 344, and with a pin 348 mounted proximate second end 346 for engagement with a position selector 350. Actuation arm 342 has first (FIG. 5) and second (FIG. 6) rotational positions corresponding to the first and second positions of rate selection gear 334. Position selector 350 is rotatably mounted to rotate about an axis of rotation generally parallel to that of actuation arm 342, and includes a slot 352 through which pin 348 of actuation arm 342 projects, thereby forming a pin and slot mechanism that mechanically couples actuation arm 342 to position selector 350. Slot 352 is configured such that, when actuation arm 342 is in the first rotational position (FIG. 5), pin 348 is oriented proximate one end of slot 352, and when actuation arm 342 is in the second rotational position (FIG. 6), pin 348 is oriented proximate an opposite end of slot 352.

Figure 5:
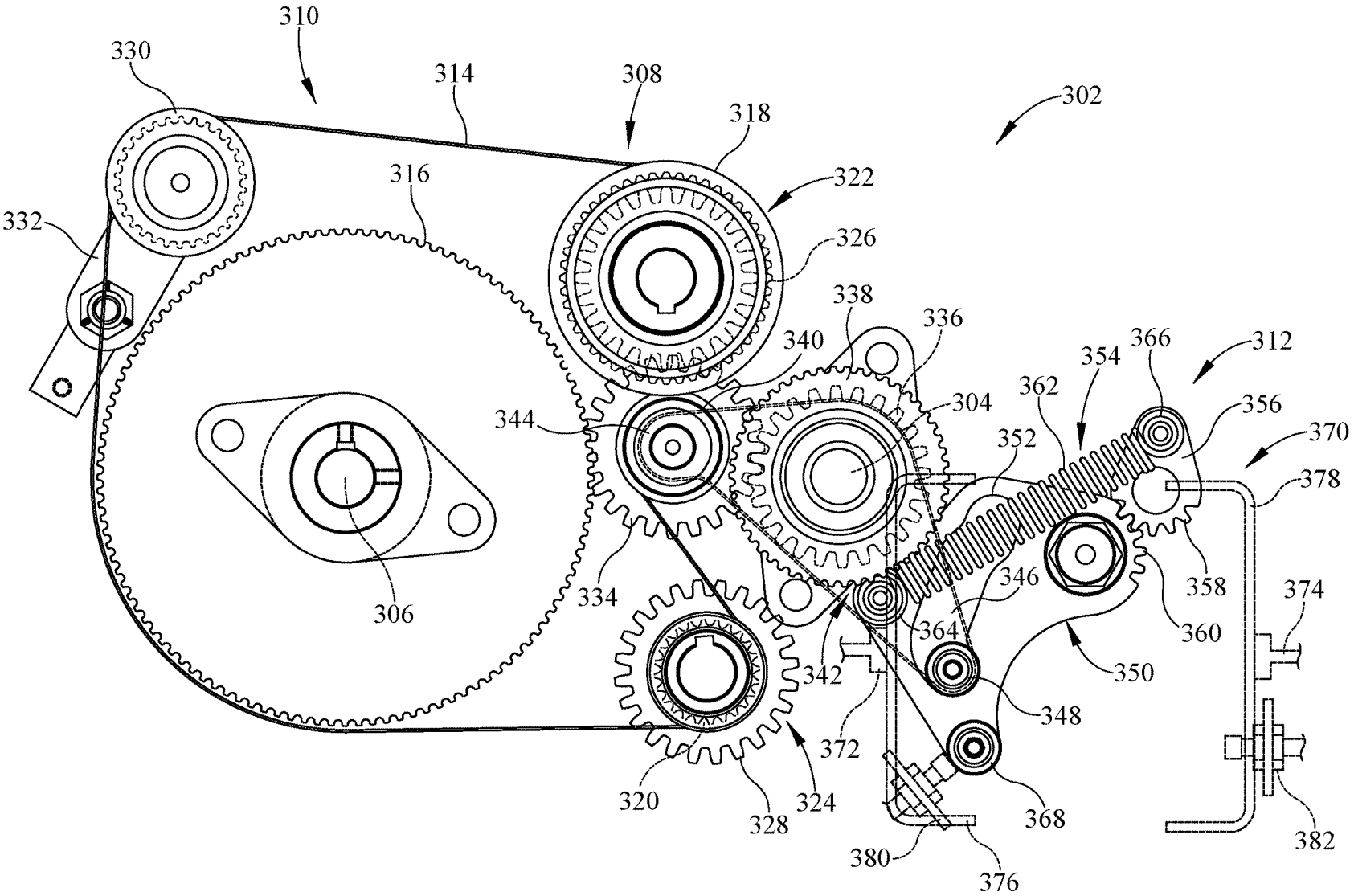
FIGS. 5 and 6 are top plan views of an example implementation of a portion of the packaging material dispenser of FIGS. 3-4, with the pre-stretch assembly respectively configured to apply a first amount of pre-stretch (FIG. 5) and a second amount of pre-stretch (FIG. 6).
Figure 6:
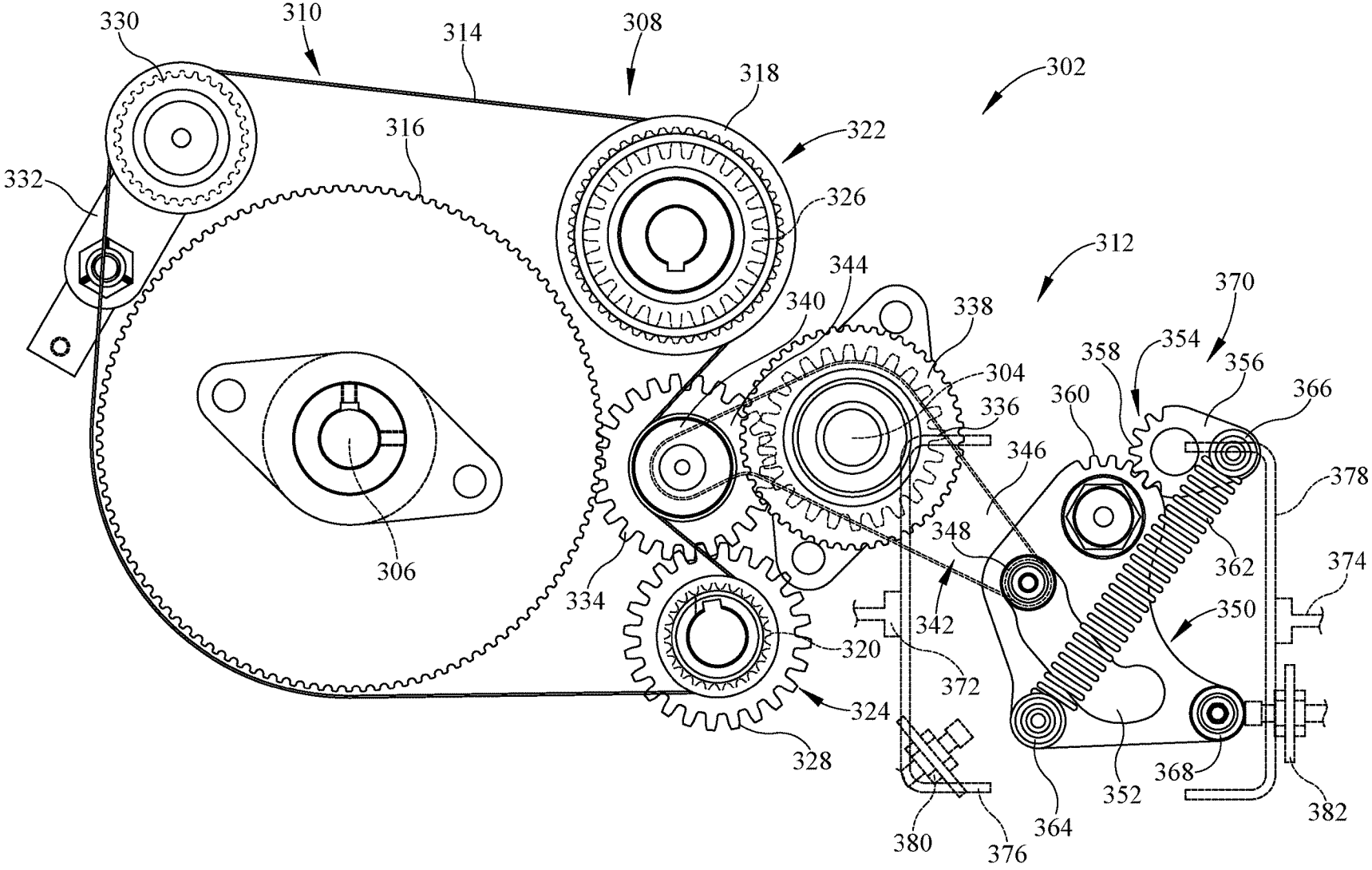

In the illustrated embodiment, position selector 350 is biased to one or both of the positions illustrated in FIGS. 5 and 6 by a bias assembly 354 including a spring support 356 that is rotatably mounted to rotate about a parallel axis adjacent to position selector 350, and including teeth 358 that intermesh with corresponding teeth 360 on position selector 350 such that both components rotate cooperatively with one another. Moreover, spring mounts 364, 366 are respectively disposed on position selector 350 and spring support 356 with a spring 362 mounted therebetween. Each of spring mounts 364, 366 is eccentrically mounted on its respective component such during rotation of position selector 350 away from either of the positions illustrated in FIGS. 5 and 6, increases a distance between spring mounts 364, 366 and thereby stretching spring 362, with a maximum distance corresponding to a position that is intermediate the two positions illustrated in FIGS. 5 and 6. As such, bias assembly 354 effectively defines two ranges of rotational positions for position selector 350, the first of which is proximate the position illustrated in FIG. 5 and within which bias assembly 354 biases position selector 350 towards the position illustrated in FIG. 5, and the second of which is proximate the position illustrated in FIG. 6 and within which bias assembly 354 biases position selector 350 towards the position illustrated in FIG. 6. Consequently, through the mechanical coupling between position selector 350 and actuation arm 342, bias assembly 354 effectively biases rate selection gear 334 to engage with either of pre-stretch rate gears 326, 328 at any given time.

Selection of different positions via position selector 350 may be implemented in a number of manners in different embodiments. In some embodiments, for example, an operator may manually move position selector between positions between wrap cycles. In other embodiments, however, an automated mechanism may be used. In a ring-type stretch wrapping machine such as illustrated in FIGS. 3-6, for example, position selector 350 may include an actuation member 368, and a pusher assembly 370 capable of pushing actuation member 368 between the positions illustrated in FIGS. 5 and 6. Pusher assembly 370 may include a pair of controlled actuators 372, 374 respectively coupled to pushers 376 and 378, and each having a throw that is sufficient to push actuation member 368 into the range of rotational positions that biases position selector 350 towards the other rotational position, such that actuation of controlled actuator 372 transitions position selector 350 from the position illustrated in FIG. 5 to the position illustrated in FIG. 6, and actuation of controlled actuator 374 transitions position selector 350 from the position illustrated in FIG. 6 to the position illustrated in FIG. 5. In the illustrated embodiment, one or more sensors, e.g., proximity sensors 380, 382, may also be included to detect the current position of position selector 350. The controller of apparatus 300 (not shown in FIGS. 3-6) is therefore able to actuate pre-stretch drive 308 to select between first and second rates of rotation for upstream pre-stretch roller 306 relative to downstream pre-stretch roller 304, and thus control the pre-stretch amount, by actuating one of controlled actuators 372, 374 to rotate position selector 350 to one of two positions that engage rate selection gear 334 with either pre-stretch rate gear 326 or pre-stretch rate gear 328.

Controlled actuators 372, 374 may be implemented in different manners, e.g., using a linear actuator, solenoid, pneumatic actuator, hydraulic actuator, etc. Further, in other embodiments, only a single actuator may be used. In addition, in some embodiments, multiple actuation members 368 may be provided on position selector 350 such that pushers 376, 378 engage different actuation members.

Pusher assembly 370 in the illustrated embodiment, which is utilized on a ring-type stretch wrapping machine, may be mounted on supporting structure of the machine, and thus not disposed on packaging material dispenser 302 or otherwise supported for rotation on a rotating ring. Pusher assembly 370 may be movable between an operative position as illustrated in FIGS. 5-6 and an inoperative position that is outside of the path of the rotating components of the stretch wrapping machine (e.g., via rotation and/or linear movement) such that switching between different pre-stretch amounts is only permitted when the packaging material dispenser is stationary and at a predetermined position, and between wrap cycles. In other embodiments, however, a pusher assembly may be mounted on a packaging material dispenser or otherwise movable therewith, and in some embodiments, switching between different amounts of pre-stretch may be performed during a wrap cycle or otherwise while a packaging material dispenser is dispensing packaging material.

It will also be appreciated that a wide variety of alternate structures may be used to move position selector 350 between different positions. Furthermore, various mechanical arrangements other than that illustrated in FIGS. 3-6 may be used to move rate selection gear 334 between engagement with one of pre-stretch rate gears 326, 328. Therefore, the invention is not limited to the particular configuration illustrated in FIGS. 3-6.

Figure 3:
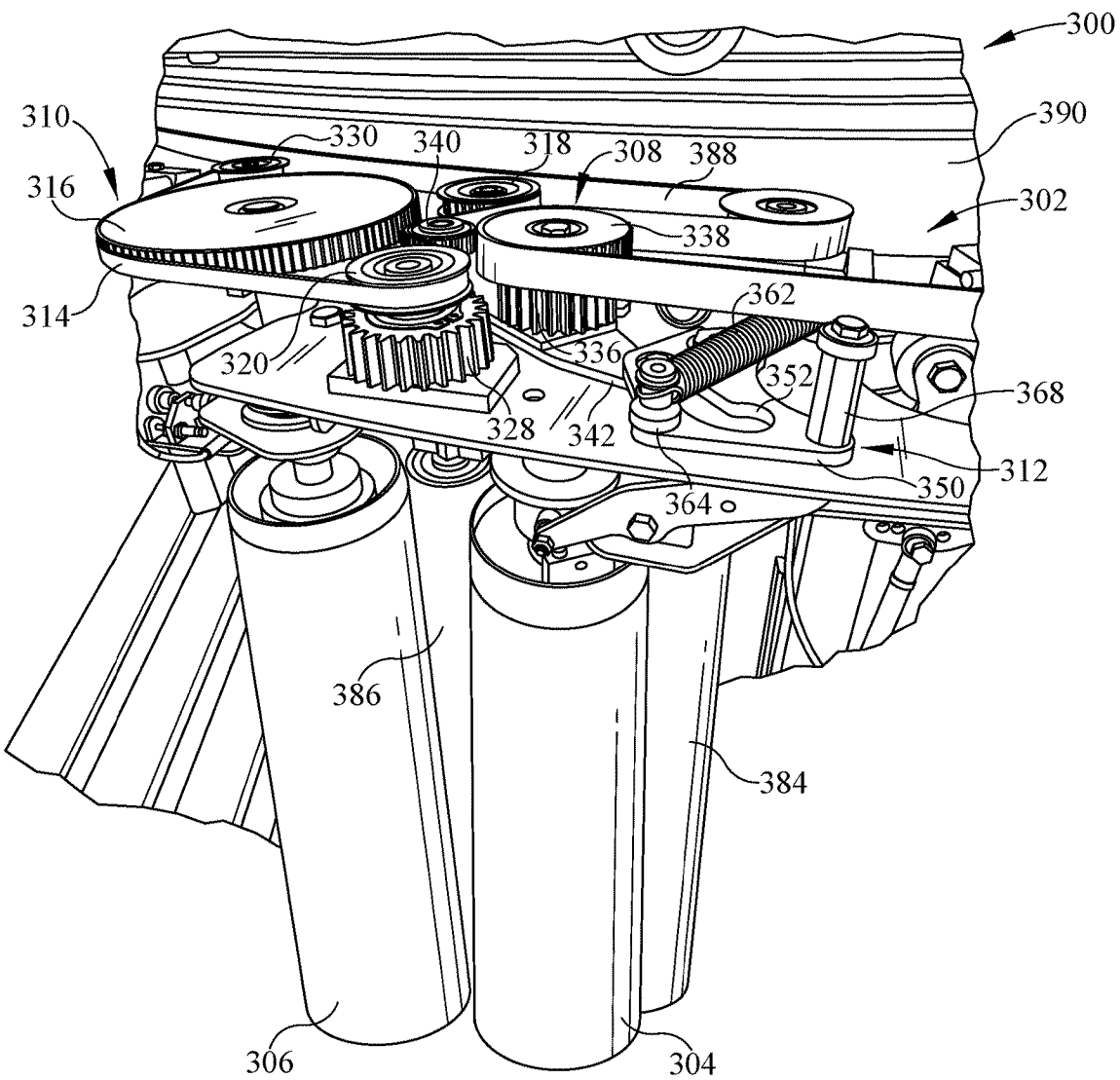
FIGS. 3 and 4 are perspective views of an example implementation of a packaging material dispenser incorporating dual pre-stretch consistent with the invention.
Figure 4:
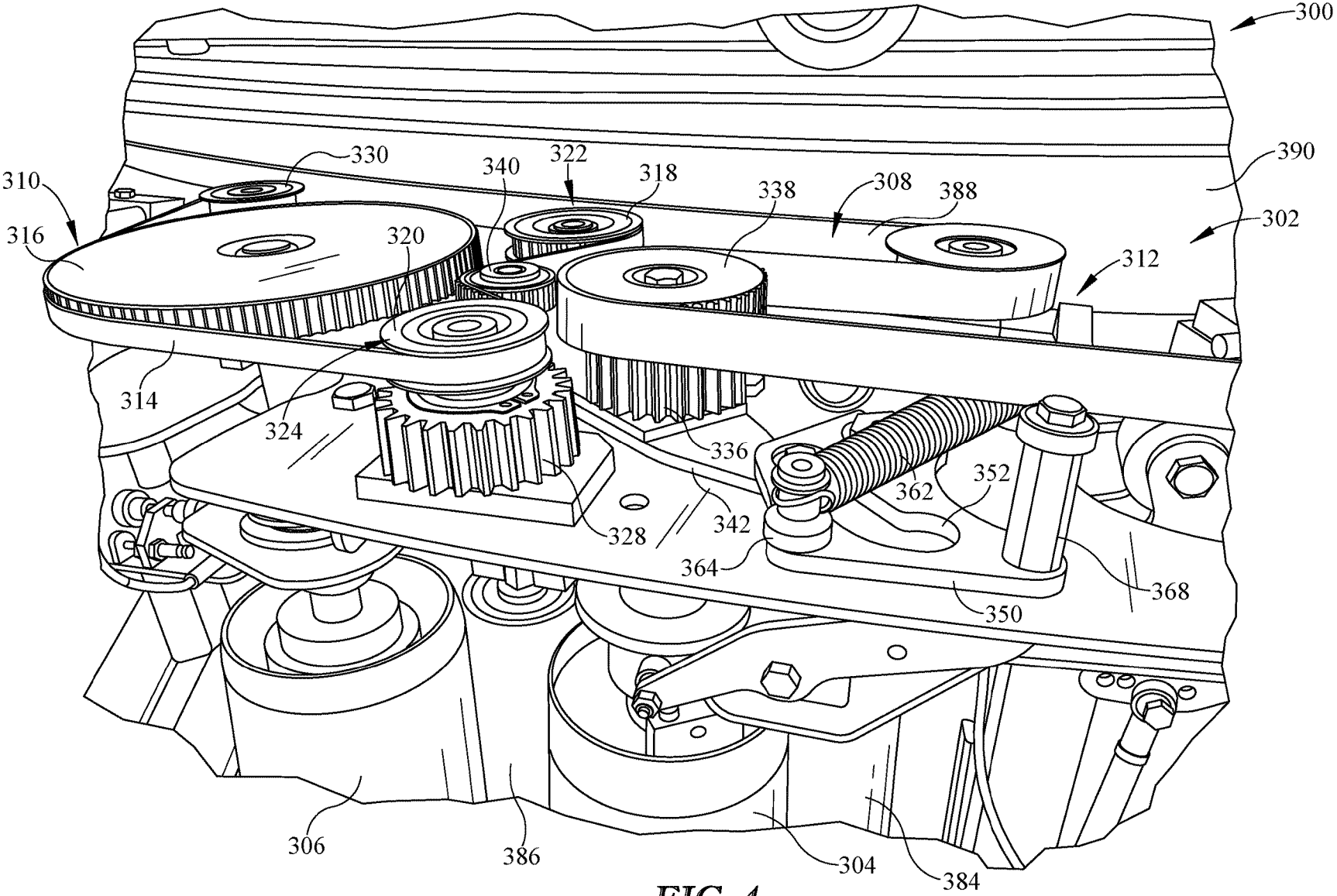

With reference to FIGS. 3-4, it will be appreciated that packaging material dispenser 302 may include additional components, e.g., one or more idle rollers 384, 386, as well as a packaging material roll (not shown in FIGS. 3-4). Furthermore, in the illustrated embodiment, packaging material dispenser drive input 338 may be implemented as a toothed wheel that is driven by a ring belt 388 disposed on a fixed or rotating ring 390, or in other manners suitable for the type of stretch wrapping machine upon which the packaging material dispenser is used.

In the illustrated embodiment, loop drive assembly 310 supports two discrete relative rates of rotation, although in other embodiments more than two discrete relative rates of rotation may be supported (e.g., through the addition of one or more additional pre-stretch rate assemblies engaging continuous loop member 328). Furthermore, while loop drive assembly 310 drives upstream pre-stretch roller 306 relative to rotation of downstream pre-stretch roller 304, in other embodiments a loop drive assembly may drive a downstream pre-stretch roller relative to rotation of an upstream pre-stretch roller.

In operation, a controller of a stretch wrapping machine (e.g., controller 170 of FIG. 2) may actuate a pre-stretch drive (e.g., pre-stretch drive 308) to select one of multiple discrete pre-stretch amounts supported by the drive, e.g., by actuating one of controlled actuators 372, 374 of FIGS. 5-6. The selection of a pre-stretch amount may be performed in response to operator input, or may be performed in response to a profile established for a particular type of load, in response to analysis of the load (e.g., a lower pre-stretch amount may be desirable in applications where sharp edges are detected on a load), or in other appropriate situations. Once the pre-stretch amount is selected, a wrap cycle may be initiated such that one or more loads are wrapped using the selected pre-stretch amount.

It will therefore be appreciated that the herein-described configuration enables multiple pre-stretch amounts to be supported by a packaging material dispenser of a stretch wrapping machine in a reliable and cost-effective manner. Other embodiments will be apparent to those skilled in the art from consideration of the specification and practice of the present invention. It is intended that the specification and examples be considered as exemplary only, with a true scope and spirit of the disclosure being indicated by the following claims.

What is claimed is:

1. An apparatus for wrapping a load with packaging material, the apparatus comprising:

a packaging material dispenser for dispensing packaging material to the load, the packaging material dispenser including:

a first pre-stretch roller and a second pre-stretch roller; and a pre-stretch drive operably coupling the first and second pre-stretch rollers to one another to drive the second pre-stretch roller at one of a first rate of rotation and a second rate of rotation relative to the first pre-stretch roller, the pre-stretch drive including:

a drive gear operably coupled to rotate the first pre-stretch roller;

a driven wheel operably coupled to rotate the second pre-stretch roller;

a first pre-stretch rate assembly and a second pre-stretch rate assembly, each of the first and second pre-stretch rate assemblies including a wheel operably coupled to rotate with an associated gear, the wheel and the associated gear of the first pre-stretch rate assembly configured to cause the second pre-stretch roller to rotate at the first rate of rotation relative to the first pre-stretch roller, and the wheel and the associated gear of the second pre-stretch rate assembly configured to cause the second pre-stretch roller to rotate at the second rate of rotation relative to the first pre-stretch roller;

a continuous loop member operably coupling the wheel of the first pre-stretch rate assembly and the wheel of the second pre-stretch rate assembly to the driven wheel;

a rate selection gear operably engaged with the drive gear and being movable between a first position and a second position, wherein in the first position the rate selection gear operably engages with the gear of the first pre-stretch rate assembly to operably couple the drive gear to the gear of the first pre-stretch rate assembly, and wherein in the second position the rate selection gear operably engages with the gear of the second pre-stretch rate assembly to operably couple the drive gear to the gear of the second pre-stretch rate assembly; and a rotational drive configured to generate relative rotation between the packaging material dispenser and the load about a center of rotation.

2. The apparatus of claim 1, wherein each of the driven wheel, the wheel of the first pre-stretch rate assembly, and the wheel of the second pre-stretch rate assembly is a pulley and the continuous loop member is a belt.

3. The apparatus of claim 1, wherein each of the driven wheel, the wheel of the first pre-stretch rate assembly, and the wheel of the second pre-stretch rate assembly is a toothed pulley and the continuous loop member is a toothed belt.

4. The apparatus of claim 1, wherein each of the driven wheel, the wheel of the first pre-stretch rate assembly, and the wheel of the second pre-stretch rate assembly is a sprocket and the continuous loop member is a chain.

5. The apparatus of claim 1, wherein the pre-stretch drive further includes a rate selection wheel that is rotatably mounted about a common axis of rotation with the rate selection gear, wherein the continuous loop member operably couples the rate selection wheel to the driven wheel, the wheel of the first pre-stretch rate assembly, and the wheel of the second pre-stretch rate assembly.

6. The apparatus of claim 1, wherein the pre-stretch drive further includes a tensioner wheel operably coupled to the driven wheel, the wheel of the first pre-stretch rate assembly, and the wheel of the second pre-stretch rate assembly to maintain substantially constant tension in the continuous loop member.

7. The apparatus of claim 1, wherein the wheel and the associated gear of the first pre-stretch rate assembly are coaxial, the wheel and the associated gear of the second pre-stretch rate assembly are coaxial, the driven wheel and the second pre-stretch roller are coaxial, and the drive gear and the first pre-stretch roller are coaxial.

8. The apparatus of claim 1, wherein each of the first and second pre-stretch rollers, the driven wheel, the drive gear, the wheel and the associated gear of the first pre-stretch rate assembly, the wheel and the associated gear of the second pre-stretch rate assembly, and the rate selection gear rotate about respective rotational axes that are generally parallel to one another.

9. The apparatus of claim 1, wherein the rate selection gear is movable between the first and second positions through generally linear movement.

10. The apparatus of claim 1, wherein the rate selection gear is movable between the first and second positions through generally rotational movement.

11. The apparatus of claim 1, wherein the pre-stretch drive further includes a rotatable actuation arm having an axis of rotation, wherein the rate selection gear is rotatably mounted to the rotatable actuation arm, and wherein the first position of the rate selection gear corresponds to a first rotational position of the actuation arm and the second position of the rate selection gear corresponds to a second rotational position of the actuation arm.

12. The apparatus of claim 11, wherein the axis of rotation of the actuation arm is coaxial with the drive gear.

13. The apparatus of claim 11, wherein the pre-stretch drive further includes a position selector operably coupled to the actuation arm to rotate the actuation arm between the first and second rotational positions.

14. The apparatus of claim 13, wherein the position selector is operably coupled to the actuation arm through a pin and slot mechanism.

15. The apparatus of claim 14, wherein the pin and slot mechanism includes a pin disposed on the actuation arm and a slot disposed on the position selector.

16. The apparatus of claim 15, wherein the position selector is rotatable about an axis of rotation, wherein when the actuation arm is in the first rotational position, the pin is oriented proximate a first end of the slot and when the actuation arm is in the second rotational position, the pin is oriented proximate a second end of the slot.

17. The apparatus of claim 16, wherein the pre-stretch drive further includes a bias assembly configured to bias the actuation arm towards at least one of the first and second rotational positions.

18. The apparatus of claim 17, wherein the bias assembly biases the actuation arm towards the first rotational position when the actuation arm is within a first range of rotational positions adjacent the first rotational position and biases the actuation arm towards the second rotational position when the actuation arm is within a second range of rotational positions adjacent the first rotational position.

19. The apparatus of claim 18, wherein the bias assembly includes a rotatable spring support disposed adjacent the position selector and a spring anchored between a first spring mount and a second spring mount respectively disposed on the rotatable spring support and the position selector, and wherein the rotatable spring support and the position selector include intermeshed teeth such that rotation of the actuation arm away from either of the first and second rotational positions rotates the rotatable spring support and the position selector to increase a distance between the first and second spring mounts.

20. The apparatus of claim 11, further comprising a controlled actuator configured to rotate the actuation arm between the first and second rotational positions.

21. The apparatus of claim 20, wherein the controlled actuator is a linear actuator, a pneumatic actuator, a hydraulic actuator or a solenoid.

22. The apparatus of claim 20, wherein the controlled actuator is a first controlled actuator configured to rotate the actuation arm from the first rotational position to the second rotational position, and wherein the pre-stretch drive further comprises a second controlled actuator configured to rotate the actuation arm from the second rotational position to the first rotational position.

23. The apparatus of claim 22, wherein the pre-stretch drive further includes:

a rotatable position selector operably coupled to the actuation arm to rotate the actuation arm between the first and second rotational positions; and a bias assembly configured to bias the actuation arm towards the first rotational position when the actuation arm is within a first range of rotational positions adjacent the first rotational position and bias the actuation arm towards the second rotational position when the actuation arm is within a second range of rotational positions adjacent the first rotational position, wherein the position selector includes one or more actuation members, and wherein the first controlled actuator is configured to engage an actuation member from among the one or more actuation members of the position selector to rotate the actuation arm into the second range of rotational positions and the second controlled actuator is configured to engage an actuation member from among the one or more actuation members of the position selector to rotate the actuation arm into the first range of rotational positions.

24. The apparatus of claim 1, further comprising a controller coupled to the packaging material dispenser and the rotational drive and configured to control a dispense rate of the packaging material dispenser during relative rotation between the packaging material dispenser and the load, and wherein the controller is further configured to actuate the pre-stretch drive to select between the first and second rates of rotation.

25. The apparatus of claim 1, further comprising a ring, wherein the packaging material dispenser is supported on the ring and the rotational drive rotates the ring to rotate the packaging material dispenser about the load.

26. A packaging material dispenser for dispensing packaging material to a load during relative rotation between the packaging material dispenser and the load, the packaging material dispenser comprising:

a first pre-stretch roller and a second pre-stretch roller; and a pre-stretch drive operably coupling the first and second pre-stretch rollers to one another to drive the second pre-stretch roller at one of first and second rates of rotation relative to the first pre-stretch roller, the pre-stretch drive including:

a drive gear operably coupled to rotate the first pre-stretch roller;

a driven wheel operably coupled to rotate the second pre-stretch roller;

a first pre-stretch rate assembly and a second pre-stretch rate assembly, each of the first and second pre-stretch rate assemblies including a wheel operably coupled to rotate with an associated gear, the wheel and the associated gear of the first pre-stretch rate assembly configured to cause the second pre-stretch roller to rotate at the first rate of rotation relative to the first pre-stretch roller, and the wheel and the associated gear of the second pre-stretch rate assembly configured to cause the second pre-stretch roller to rotate at the second rate of rotation relative to the first pre-stretch roller;

a continuous loop member operably coupling the wheel of the first pre-stretch rate assembly and the wheel of the second pre-stretch rate assembly to the driven wheel; and a rate selection gear operably engaged with the drive gear and being movable between a first position and a second position, wherein in the first position the rate selection gear operably engages with the gear of the first pre-stretch rate assembly to operably couple the drive gear to the gear of the first pre-stretch rate assembly, and wherein in the second position the rate selection gear operably engages with the gear of the second pre-stretch rate assembly to operably couple the drive gear to the gear of the second pre-stretch rate assembly.

27. A method of wrapping a load with packaging material using a wrapping apparatus of the type including a packaging material dispenser for dispensing packaging material to the load, the method comprising:

rotating a first pre-stretch roller of the packaging material dispenser at a controlled rate of rotation in response to a packaging material dispenser drive input;

rotating a second pre-stretch roller of the packaging material dispenser in response to rotation of a driven wheel;

driving the driven wheel using a continuous loop member operably coupling the driven wheel to a respective wheel of a first pre-stretch rate assembly and a respective wheel of a second pre-stretch rate assembly, the first and second pre-stretch rate assemblies each further including respective gears configured to rotate with the respective wheels thereof, the wheel and the gear of the first pre-stretch rate assembly configured to cause the second pre-stretch roller to rotate at a first rate of rotation relative to the controlled rate of rotation of the first pre-stretch roller, and the wheel and the associated gear of the second pre-stretch rate assembly configured to cause the second pre-stretch roller to rotate at a second rate of rotation relative to the controlled rate of rotation of the first pre-stretch roller;

rotating a drive gear operably coupled to the first pre-stretch roller in response to the packaging material dispenser drive input;

selecting the first rate of rotation for the second pre-stretch roller by moving a rate selection gear operably engaged with the drive gear to a first position in which the rate selection gear operably engages with the gear of the first pre-stretch rate assembly to operably couple the drive gear to the gear of the first pre-stretch rate assembly; and selecting the second rate of rotation for the second pre-stretch roller by moving the rate selection gear to a second position in which the rate selection gear operably engages with the gear of the second pre-stretch rate assembly to operably couple the drive gear to the gear of the second pre-stretch rate assembly.

28. A method of wrapping a load with packaging material using a wrapping apparatus of the type including a packaging material dispenser for dispensing packaging material to the load, the method comprising:

rotating a first pre-stretch roller of the packaging material dispenser at a controlled rate of rotation in response to a packaging material dispenser drive input;

rotating a second pre-stretch roller of the packaging material dispenser using a loop drive assembly including a first pre-stretch rate wheel and a second pre-stretch rate wheel, a driven wheel operably coupled to rotate the second pre-stretch roller, a continuous loop member operably coupling the first pre-stretch rate wheel, the second pre-stretch rate wheel, and the driven wheel;

selecting a first rate of rotation at which to rotate the second pre-stretch roller relative to the first pre-stretch roller by actuating a rate selection assembly to operably couple the packaging material dispenser drive input to the first pre-stretch rate wheel such that the first pre-stretch rate wheel drives the loop drive assembly in response to the packaging material dispenser drive input; and selecting a second rate of rotation at which to rotate the second pre-stretch roller relative to the first pre-stretch roller by actuating the rate selection assembly to operably couple the packaging material dispenser drive input to the second pre-stretch rate wheel such that the second pre-stretch rate wheel drives the loop drive assembly in response to the packaging material dispenser drive input;

wherein the rate selection assembly and the first pre-stretch rate wheel are configured such that when the rate selection assembly is actuated to operably couple the packaging material dispenser drive input to the first pre-stretch rate wheel, the second pre-stretch roller is driven at the first rate of rotation relative to the first pre-stretch roller, and such that when the rate selection assembly is actuated to operably couple the packaging material dispenser drive input to the second pre-stretch rate wheel, the second pre-stretch roller is driven at the second rate of rotation relative to the first pre-stretch roller.

29. The method of claim 28, wherein each of the driven wheel, the first pre-stretch rate wheel, and the second pre-stretch rate wheel is a pulley and the continuous loop member is a belt.

30. The method of claim 28, wherein each of the driven wheel, the first pre-stretch rate wheel, and the second pre-stretch rate wheel is a sprocket and the continuous loop member is a chain.

31. The method of claim 28, further comprising rotating a drive gear operably coupled to the first pre-stretch roller in response to the packaging material dispenser drive input, wherein actuating the rate selection assembly to operably couple the packaging material dispenser drive input to the first pre-stretch rate wheel includes moving a rate selection gear operably engaged with the drive gear to a first position in which the rate selection gear operably engages with a first pre-stretch rate gear operably coupled to rotate with the first pre-stretch rate wheel, and wherein actuating the rate selection assembly to operably couple the packaging material dispenser drive input to the second pre-stretch rate wheel includes moving the rate selection gear to a second position in which the rate selection gear operably engages with a second pre-stretch rate gear operably coupled to rotate with the second pre-stretch rate wheel.

32. The method of claim 31, wherein the loop drive assembly further includes a tensioner wheel and a rate selection wheel that is rotatably mounted about a common axis of rotation with the rate selection gear, and wherein the continuous loop member operably couples the rate selection wheel and the tensioner wheel to the driven wheel, the first pre-stretch rate wheel, and the second pre-stretch rate wheel.

33. The method of claim 31, wherein the rate selection gear is rotatably mounted to a rotatable actuation arm having an axis of rotation, wherein the first and second positions of the rate selection gear respectively correspond to a first rotational position of the actuation arm and a second rotational position of the actuation arm, wherein actuating the rate selection assembly to operably couple the packaging material dispenser drive input to the first pre-stretch rate wheel includes rotating the actuation arm to the first rotational position, and wherein actuating the rate selection assembly to operably couple the packaging material dispenser drive input to the second pre-stretch rate wheel includes rotating the actuation arm to the second rotational position.

34. The method of claim 33, wherein the actuation arm is operably coupled to a rotatable position selector through a pin and slot mechanism, wherein when the actuation arm is in the first rotational position, the pin is oriented proximate a first end of the slot and when the actuation arm is in the second rotational position, the pin is oriented proximate a second end of the slot, wherein a bias assembly coupled to the rotatable position selector biases the actuation arm towards the first rotational position when the actuation arm is within a first range of rotational positions adjacent the first rotational position and biases the actuation arm towards the second rotational position when the actuation arm is within a second range of rotational positions adjacent the first rotational position, wherein actuating the rate selection assembly to operably couple the packaging material dispenser drive input to the first pre-stretch rate wheel includes rotating the actuation arm to a rotational position within the first range of rotational positions such that the bias assembly further rotates the actuation arm to the first rotational position, and wherein actuating the rate selection assembly to operably couple the packaging material dispenser drive input to the second pre-stretch rate wheel includes rotating the actuation arm to a rotational position within the second range of rotational positions such that the bias assembly further rotates the actuation arm to the second rotational position.

35. The method of claim 34, wherein actuating the rate selection assembly to operably couple the packaging material dispenser drive input to the first pre-stretch rate wheel includes actuating a first controlled actuator that pushes the position selector to rotate the actuation arm to the rotational position within the first range of rotational positions, and wherein actuating the rate selection assembly to operably couple the packaging material dispenser drive input to the second pre-stretch rate wheel includes actuating a second controlled actuator that pushes the position selector to rotate the actuation arm to the rotational position within the second range of rotational positions.

36. The method of claim 35, wherein each of the first and second controlled actuators is a linear actuator, a pneumatic actuator, a hydraulic actuator or a solenoid.

37. A packaging material dispenser for dispensing packaging material to a load during relative rotation between the packaging material dispenser and the load, the packaging material dispenser including:

a first pre-stretch roller and a second pre-stretch roller; and a pre-stretch drive operably coupling the first and second pre-stretch rollers to one another to drive the first pre-stretch roller at a first rate of rotation and a second rate of rotation relative to the second pre-stretch roller, the pre-stretch drive including:

a loop drive assembly including a first pre-stretch rate wheel and a second pre-stretch rate wheel, a driven wheel operably coupled to rotate the second pre-stretch roller, and a continuous loop member operably coupling the first and second pre-stretch rate wheels and the driven wheel; and a rate selection assembly operably coupled to a packaging material dispenser drive input and operable in a first mode and a second mode, wherein in the first mode the rate selection assembly operably couples the packaging material drive input to the first pre-stretch rate wheel to drive the loop drive assembly using the first pre-stretch rate wheel, and in the second mode the rate selection assembly operably couples the packaging material drive input to the second pre-stretch rate wheel to drive the loop drive assembly using the second pre-stretch rate wheel;

wherein the rate selection assembly and the first pre-stretch rate wheel are configured such that when the rate selection assembly is in the first mode, the second pre-stretch roller is driven at the first rate of rotation relative to the first pre-stretch roller, and such that when the rate selection assembly is in the second mode, the second pre-stretch roller is driven at the second rate of rotation relative to the first pre-stretch roller.

38. An apparatus for wrapping a load with packaging material, the apparatus comprising:

a packaging material dispenser including a first pre-stretch roller, a second pre-stretch roller and a pre-stretch drive operably coupling the first and second pre-stretch rollers to one another to drive the second pre-stretch roller at one of first and second rates of rotation relative to the first pre-stretch roller, the pre-stretch drive including:

a loop drive assembly including first and second pre-stretch rate wheels, a driven wheel operably coupled to rotate the second pre-stretch roller, and a continuous loop member operably coupling the first and second pre-stretch rate wheels and the driven wheel; and a rate selection assembly operably coupled to a packaging material dispenser drive input and operable in first and second modes, wherein in the first mode the rate selection assembly operably couples the packaging material drive input to the first pre-stretch rate wheel to drive the loop drive assembly using the first pre-stretch rate wheel, and in the second mode the rate selection assembly operably couples the packaging material drive input to the second pre-stretch rate wheel to drive the loop drive assembly using the second pre-stretch rate wheel;

wherein the rate selection assembly and the first pre-stretch rate wheel are configured such that when the rate selection assembly is in the first mode, the second pre-stretch roller is driven at the first rate of rotation relative to the first pre-stretch roller, and such that when the rate selection assembly is in the second mode, the second pre-stretch roller is driven at the second rate of rotation relative to the first pre-stretch roller; and a rotational drive configured to generate relative rotation between the packaging material dispenser and the load about a center of rotation.

39. The apparatus of claim 38, further comprising a controller coupled to the packaging material dispenser and the rotational drive and configured to control a dispense rate of the packaging material dispenser during relative rotation between the packaging material dispenser and the load, and wherein the controller is further configured to actuate the pre-stretch drive to select between the first and second rates of rotation.

40. The apparatus of claim 38, further comprising a ring, wherein the packaging material dispenser is supported on the ring and the rotational drive rotates the ring to rotate the packaging material dispenser about the load.

* * * * *